US009295602B2

(12) United States Patent
Savich

(10) Patent No.: US 9,295,602 B2
(45) Date of Patent: Mar. 29, 2016

(54) SUPPORT PLATFORM

(75) Inventor: Rebecca Savich, Sherman Oaks, CA (US)

(73) Assignee: Oakworks Inc., New Freedom, PA (US)

( * ) Notice: Subject to any disclaimer, the term of this patent is extended or adjusted under 35 U.S.C. 154(b) by 1163 days.

(21) Appl. No.: 12/807,042

(22) Filed: Aug. 25, 2010

(65) Prior Publication Data

US 2010/0325798 A1 Dec. 30, 2010

Related U.S. Application Data

(63) Continuation-in-part of application No. 12/072,039, filed on Feb. 21, 2008, now abandoned.

(51) Int. Cl.

| | |
|---|---|
| ***A61G 13/12*** | (2006.01) |
| ***A61G 13/00*** | (2006.01) |
| ***A61G 13/10*** | (2006.01) |
| *A61G 13/06* | (2006.01) |

(52) U.S. Cl.

CPC ..... *A61G 13/009* (2013.01); *A61G 13/105* (2013.01); *A61G 13/12* (2013.01); *A61G 13/06* (2013.01); *A61G 13/121* (2013.01); *A61G 2200/12* (2013.01); *A61G 2200/325* (2013.01)

(58) Field of Classification Search

USPC ..... 128/845, 846, 870; 5/735, 731, 631, 5/632, 930, 706, 710, 713, 644, 654, 5/655.3, 110, 111, 112, 114, 116, 117, 5/488

See application file for complete search history.

(56) References Cited

U.S. PATENT DOCUMENTS

| | | | | |
|---|---|---|---|---|
| 3,988,793 | A * | 11/1976 | Abitbol | 601/11 |
| 4,054,960 | A | 10/1977 | Pettit et al. | |
| 4,333,638 | A | 6/1982 | Gillotti | |
| 5,009,170 | A | 4/1991 | Spehar | |
| 5,088,475 | A | 2/1992 | Steffensmeier | |
| 5,185,897 | A | 2/1993 | Van Laanen | |
| 5,237,712 | A | 8/1993 | Ramsay | |
| 5,400,449 | A | 3/1995 | Satto | |
| D357,595 | S | 4/1995 | Roschacher | |
| 5,412,824 | A | 5/1995 | Emerson et al. | |
| 5,425,147 | A * | 6/1995 | Supplee et al. | 5/713 |
| 5,438,715 | A | 8/1995 | Jackman | |
| 5,652,981 | A * | 8/1997 | Singer-Leyton et al. | 5/631 |
| 5,679,040 | A | 10/1997 | Bianchi-Holm | |
| 5,819,348 | A | 10/1998 | Ryan | |
| 5,820,573 | A | 10/1998 | Ramos | |
| 5,890,246 | A | 4/1999 | Davis | |
| 5,921,696 | A | 7/1999 | Gillotti | |
| 5,974,979 | A | 11/1999 | Grady et al. | |
| 6,076,213 | A | 6/2000 | Chase, Jr. | |
| 6,148,460 | A | 11/2000 | Fried et al. | |
| 6,190,338 | B1 | 2/2001 | Arndt | |
| 6,233,768 | B1 | 5/2001 | Harding | |
| 6,568,015 | B1 | 5/2003 | Allen | |
| 6,684,431 | B2 | 2/2004 | Splane, Jr. | |
| 6,763,540 | B1 * | 7/2004 | Wang | 5/710 |
| 6,857,145 | B1 * | 2/2005 | Sikes | 5/110 |
| 6,934,988 | B1 | 8/2005 | Wetzler et al. | |

(Continued)

*Primary Examiner* — Ophelia A Hawthorne
(74) *Attorney, Agent, or Firm* — Barley Snyder

(57) ABSTRACT

An adjustable personal treatment apparatus that is usable by women of all sizes to enable them to enjoy, without harm, the full healthful benefits of proper and necessary massage and therapy. More particularly, the apparatus permits the proper pressure to be applied to a female patient during massage, or therapeutic treatment, without causing discomfort and possible damage to breast tissue or breast implants.

22 Claims, 7 Drawing Sheets

(56) References Cited

U.S. PATENT DOCUMENTS 7,069,609 B2 7/2006 Zheng
7,127,764 B1 * 10/2006 Harding et al. ..... 5/735
8,132,277 B2 * 3/2012 Buchanan ..... 5/627
2006/0031993 A1 * 2/2006 Riach ..... 5/632
2010/0064434 A1 * 3/2010 Amsler, Jr. ..... 5/488

* cited by examiner

SUPPORT PLATFORM

CROSS-REFERENCE TO RELATED APPLICATIONS

This application is a Continuation-In-Part of application U.S. Ser. No. 12/072,039 filed Feb. 21, 2008 now abandoned.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to personal treatment apparatus. More particularly, the invention concerns an apparatus that is specially designed to provide comfort to a patient while lying in a prone position.

2. Description of Related Art Including Information Disclosed Under 37 CFR 1.97 and 1.98

Because the human body has many shapes, contours and protuberances when an individual lies in a prone position, to rest, relax, sleep or receive treatment, localized discomfort, pain and even injury can result. This problem is exasperated for the mature female because, while laying face down the female cannot relax in a natural whole body extending position because the breasts cause a distortion in body position that is both uncomfortable as well as stressful for various muscle groups and tissue.

The breast tissue is primarily composed of subcutaneous fat and is almost solely supported by suspensory ligaments connecting breast skin to the tissue that rests above the pectoralis major. With traditional prior art flat treatment tables, the female patient, while lying prone will experience uncomfortable and sometimes harmful pressure on all breast tissue including stretching and tearing of the suspensory ligaments and compressing of the fat cells, often causing swelling to occur. Women with breast augmentations are faced with fear of possible ruptures and certainly severe discomfort.

Whether the individual is seeking a massage for relaxation or for therapeutic treatment, the body needs to be maintained in a relaxed position to achieve the highest degree of success. The thrust of the present invention is to provide a novel support apparatus that will achieve this result. More particularly, it is an object of the present invention to provide an adjustable personal treatment apparatus that is usable by persons of all sizes to enable them to enjoy, without harm, the full healthful benefits of proper and necessary massage and therapy.

Part of the reason that this issue has not been solved is that traditionally mattresses or, for instance a massage table, have been flat, ignoring the issues described above. Tables or mattress materials have tried to address the issue of comfort, pain or injury; however, because of the degree of contour of the human body, changing the material in and of itself is not alone enough to provide both the intended purpose of the invention, as well as the intended attributes during use.

Other similar inventions have attempted to address some of these issues, but in spite of the long history of these inventions, there remains a need for an automated, adjustable body part and contour comfort system.

A number of attempts at solving these issues have been disclosed in the following U.S. Letters Patents: U.S. Pat. No. 6,934,988 issued to Wetzler; U.S. Pat. No. 7,127,764 issued to Harding; U.S. Pat. No. 5,009,170 issued to Spehar; U.S. Pat. No. 5,088,475 issued to Steffensmeier; U.S. Pat. No. 5,921,696 issued to Gillotti; U.S. Pat. No. 7,069,609 issued to Zheng; U.S. Pat. No. 5,438,715 issued to Jackman; U.S. Pat. No. 6,190,338 issued to Arndt; U.S. Pat. No. 6,684,431 issued to Splane, Jr.; U.S. Pat. No. 6,076,213 issued to Chase, Jr.; U.S. Pat. No. 5,820,573 issued to Ramos; U.S. Pat. No. 5,974,979 issued to Grady; U.S. Pat. No. 4,333,638 issued to Gillotii; and U.S. Pat. No. 6,148,460 issued to Fried.

The structures disclosed by the forgoing references suffer from one or more of the following disadvantages: no adjustable recessed cup area, requirement that the patient stand during treatment, lack of portability, and limited adjustability.

BRIEF SUMMARY OF THE INVENTION

It is an object of the present invention to provide an adjustable personal treatment apparatus for comfortably supporting an individual while lying in a prone position.

Another object of the invention is to provide an adjustable personal treatment apparatus of the aforementioned character that is usable by persons of all sizes to enable them to enjoy, with utmost comfort and without harm, the full healthful benefits of proper and necessary massage and therapy.

Another object of the invention is to provide an adjustable personal treatment apparatus of the type described in the preceding paragraphs that permits the proper pressure to be applied to a patient during massage, or therapeutic treatment, without causing discomfort and possible damage to the patient.

Another object of the invention is to provide an adjustable personal treatment apparatus of the class described that is of a simple construction and one that is easy to operate.

Another object of the invention is to provide an adjustable personal treatment apparatus as described in which the support body is constructed from a material that is durable and easy to clean and maintain.

DETAILED DESCRIPTION OF THE INVENTION

Figure 2:
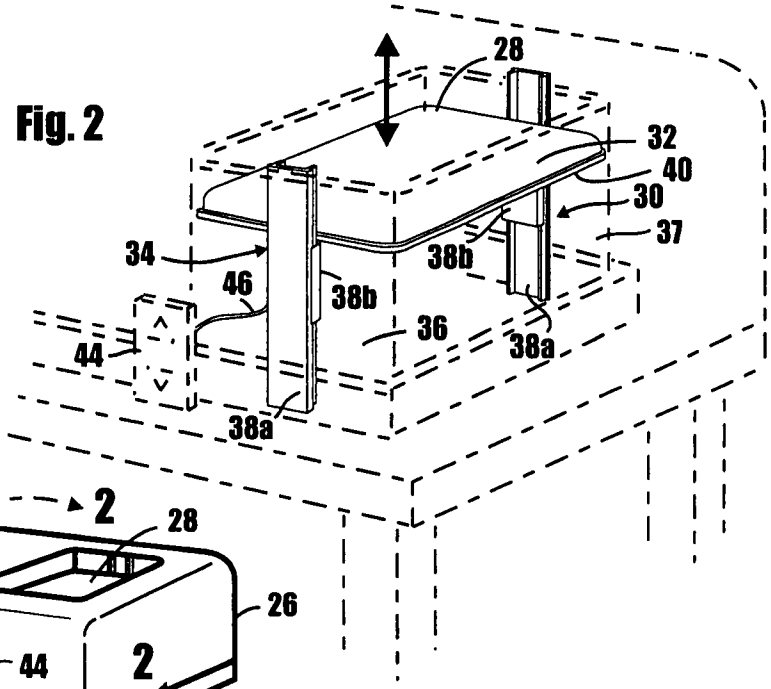
FIG. 2 is a generally perspective fragmentary view showing the forward portion of the treatment platform in phantom lines and is showing in solid lines the control subassembly of the apparatus shown in FIG. 1 for controllably positioning the breast support cushion of the apparatus.
Figure 1:
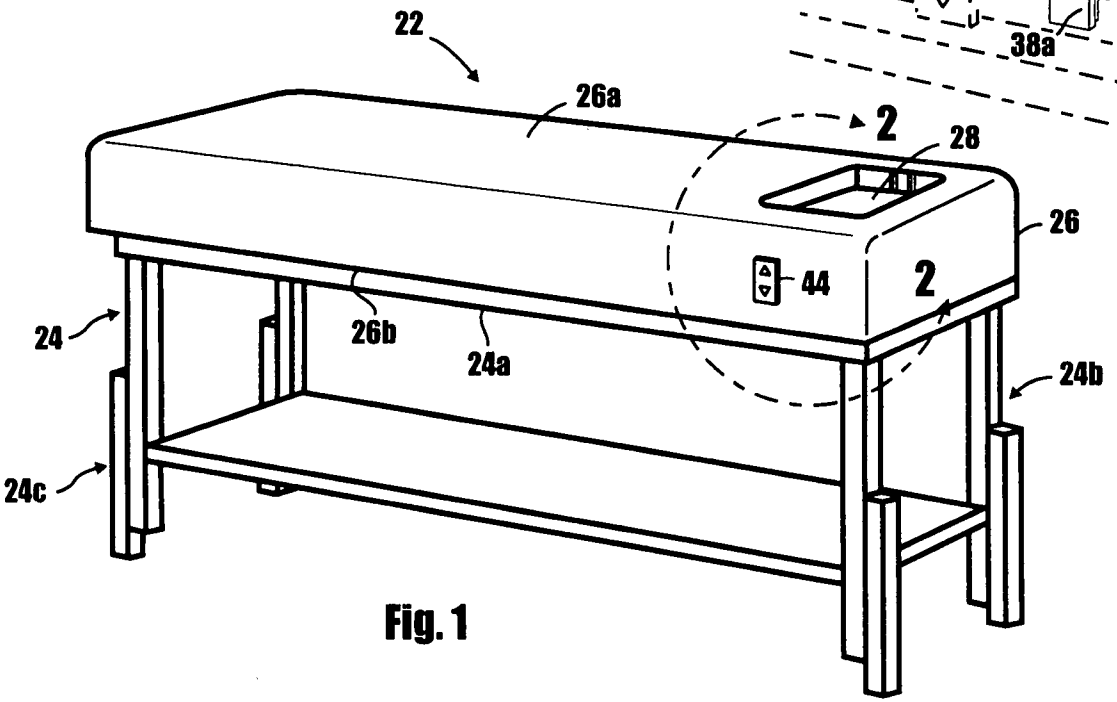
FIG. 1 is a generally perspective view of one form of the treatment or support platform of the present invention.
Figure 4:
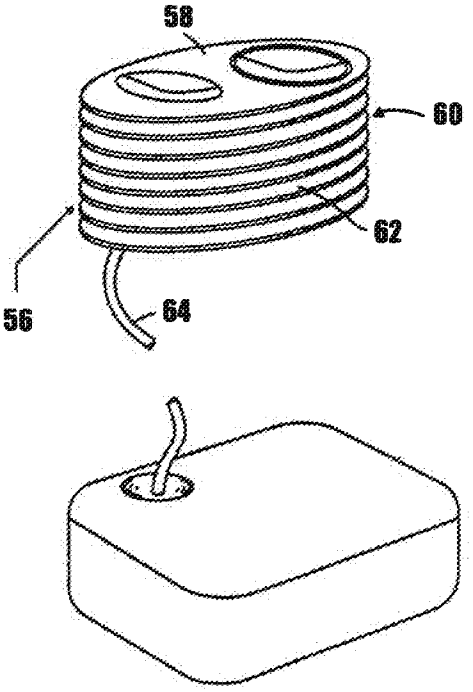
FIG. 4 is a generally perspective fragmentary view of the control subassembly of the apparatus shown in FIG. 3.
Figure 3:
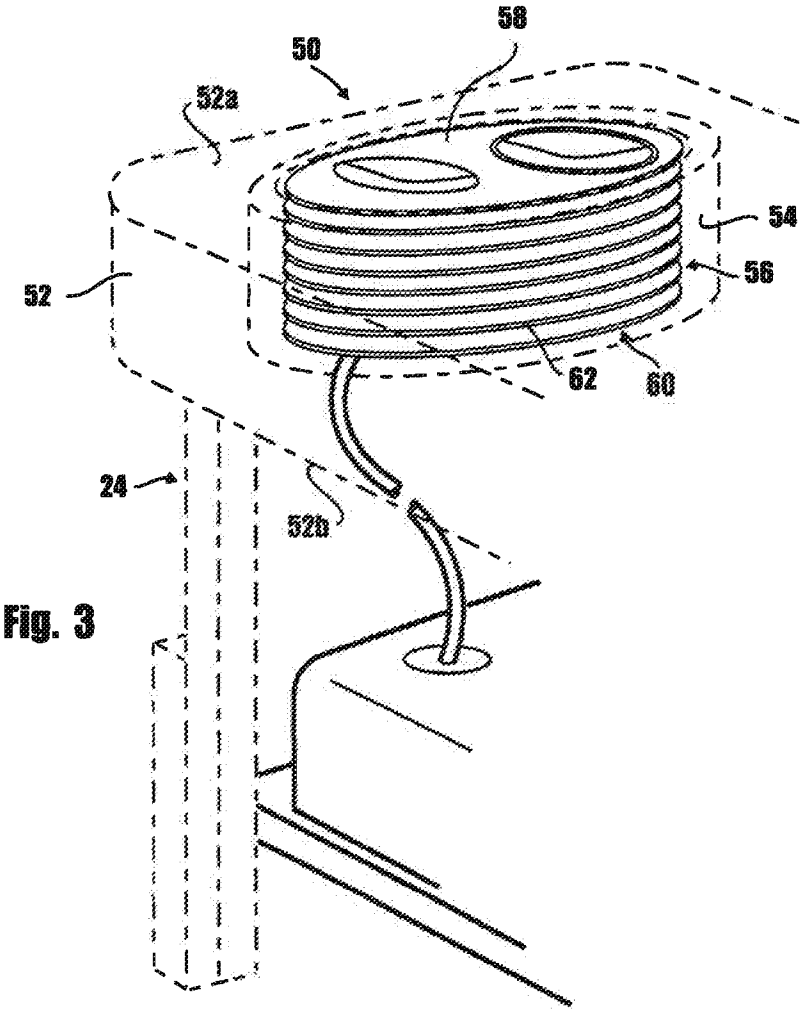
FIG. 3 is a generally perspective view showing in phantom lines the forward portion of an alternate form of treatment platform of the present invention and showing in solid lines the control subassembly for controllably positioning the breast support cushion of the apparatus.

Referring to the drawings and particularly to FIGS. 1 and 2, one form of the treatment, or support platform of the present invention for supporting an individual in a prone position is there shown and generally designated by the numeral 22. Platform 22 here comprises a supporting frame 24 that includes an upper frame 24*a* to which a pair of forward, transversely spaced, downwardly extending legs 24*b* is connected and to which a pair of rearward, transversely-spaced, downwardly extending legs 24*c* is connected. Connected to and supported by supporting frame 24 is an elongated, resilient body cushion 26, having opposing upper and lower surfaces 26*a* and 26*b*. As best seen in FIG. 1 of the drawings, upper surface 26*a* of the body, or cushion, is provided with a receiving chamber 28 for receiving the breasts of the individual being treated.

Forming an important aspect of the treatment platform 22 of the present invention is a control assembly 30 for controllably positioning a breast cushion 32 that is disposed within receiving chamber 28. Control assembly 30 here includes a breast cushion positioning mechanism generally designated by the numeral 34 for moving the breast cushion 32 within receiving chamber 28 from a first elevated position to a second lowered position. As indicated in the drawings, apportion of the breast cushion positioning mechanism 34 is connected to the inner sidewalls 36 and 37 of receiving chamber 28 (FIG. 2) and is disposed below the upper surface 26*a* of the resilient body cushion 26.

Breast cushion positioning mechanism 34 here comprises a pair of readily commercially available linear motor assemblies 38 that include elongate tracks or slides 38*a* that, in the manner shown in FIG. 2, are interconnected with the side walls 36 and 37, respectively, of the cushion receiving chamber 28. Each of the linear motor assemblies also comprises a combination electric motor and moving carriage 38*b* that is connected to a selected one of the tracks. Breast support cushion 32 is carried by a cushion support plate 40 that is positioned between and interconnected with the carriage 38*b*. When the linear motors are energized through operation of a switch 44 that is mounted on the side of the cushion 26 and interconnected with the motors by a conduit 46, the breast support cushion can be controllably moved upwardly and downwardly within the chamber 28 manner to provide optimum support to the breasts of the patient. The linear motor assemblies 38 can be obtained from a number of sources, including the Parker Hannifin Corporation of Rohnert Park, Calif. and the Tecnotion, B.V. Company of the Netherlands.

In using the apparatus of the invention shown in FIGS. 1 and 2 of the drawings, the linear motor assemblies 38 are operated in a manner to move the breast support cushion downwardly within chamber 28. This done, the patient can lay prone on the support cushion 26 with the breasts located within chamber 28. Through operation of the switch 44, the breast support cushion 32 can be raised to a position wherein the breasts of the patient are comfortably supported by the cushion 32. With the patient thusly positioned on the support table, massage or similar therapeutic manipulation of the patient can be accomplished without undue pressure being exerted upon the breasts of the patient.

Turning next to FIGS. 5 through 10, an alternate form of the treatment platform of the present invention for supporting an individual in a prone or supine position is there shown and generally designated by the numeral 52. Platform 52 here comprises a foldable supporting frame 54 that functions to support an elongated resilient body pad 56 that includes first and second sections 58 and 60. First section 58 has a forward portion 58*a* having opposing upper and lower surfaces 62 and 64 and a generally oval shaped a guide passageway 66 (see also FIGS. 5, 9, 9A and 9B).

Figure 5:
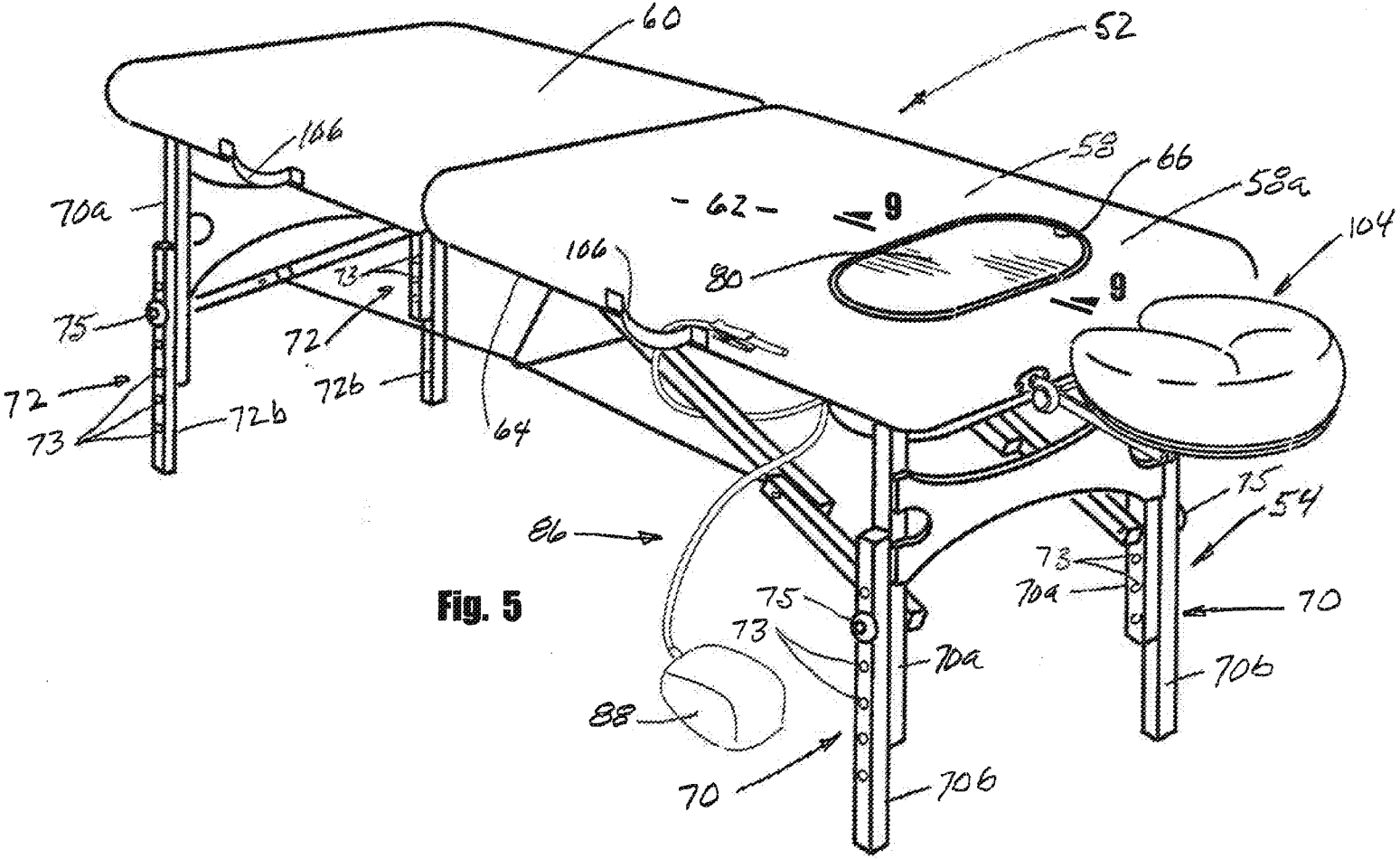
FIG. 5 is a generally perspective view of an alternate form of treatment platform of the present invention.
Figure 6:
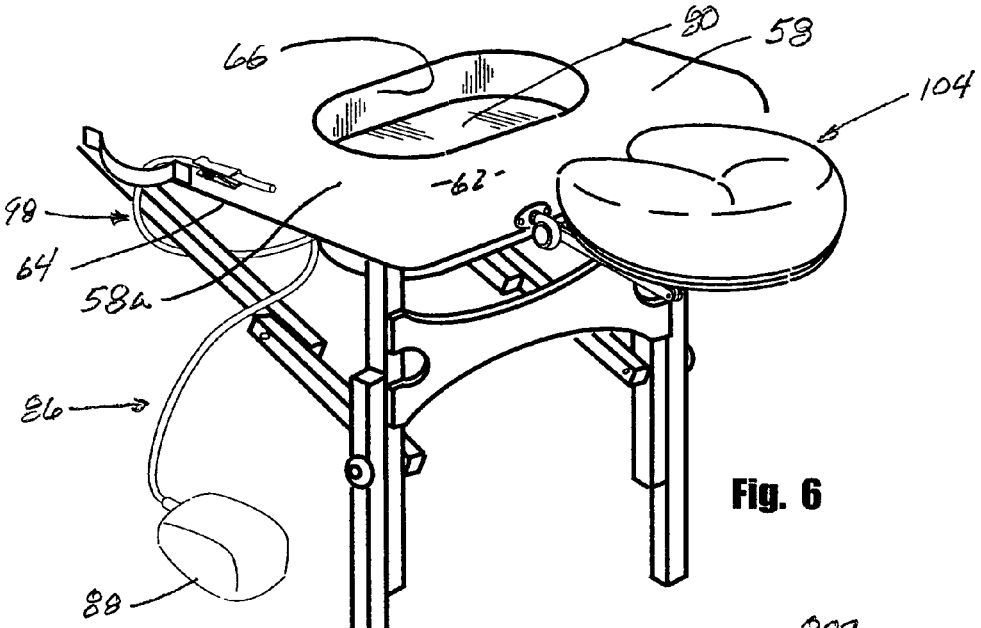
FIG. 6 is a generally perspective, fragmentary view of the forward portion of the treatment platform illustrated in FIG. 5.

As indicated in FIG. 5 of the drawings, the forward portion of the support frame 54 is provided with downwardly extending adjustable front leg assemblies 70, while the rearward portion of the support frame is provided with downwardly extending adjustable rear leg assemblies 72.

Figure 9:
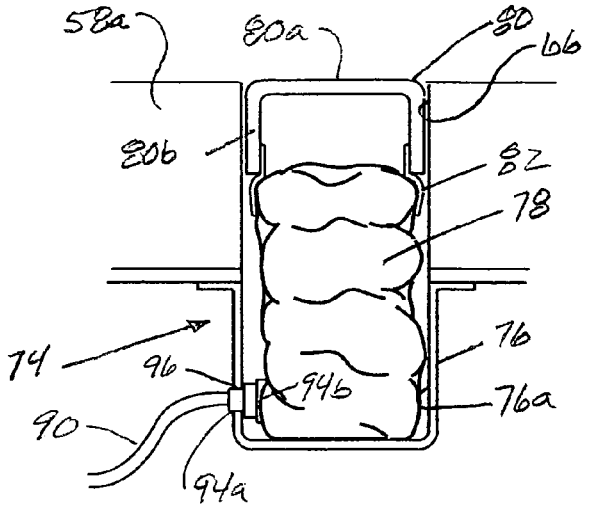
FIG. 9 is a rear view of the supporting cushion assembly of the invention illustrating the airbag of the assembly and a partially inflated configuration.
Figure 9A:
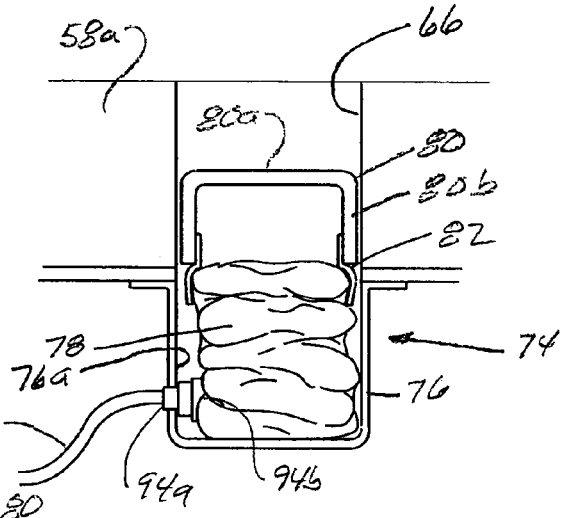
FIG. 9A is a view similar to FIG. 9 but showing the airbag of the supporting cushion assembly in a deflated configuration.
Figure 9B:
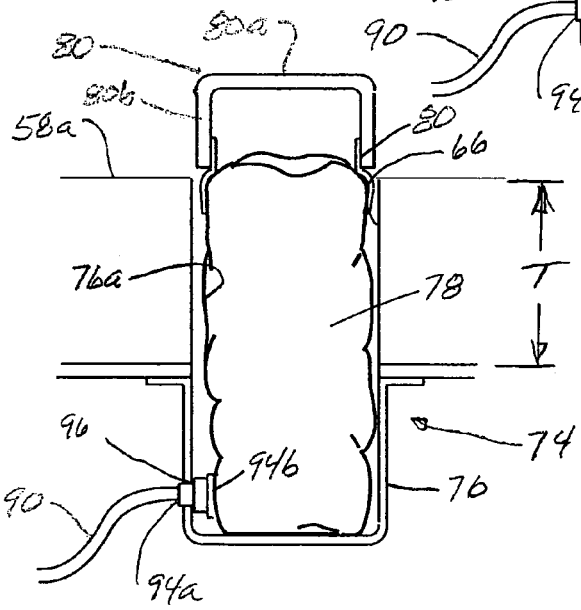
FIG. 9B is a view similar to FIG. 9 but showing the airbag of the supporting cushion assembly in a fully inflated configuration.
Figure 10:
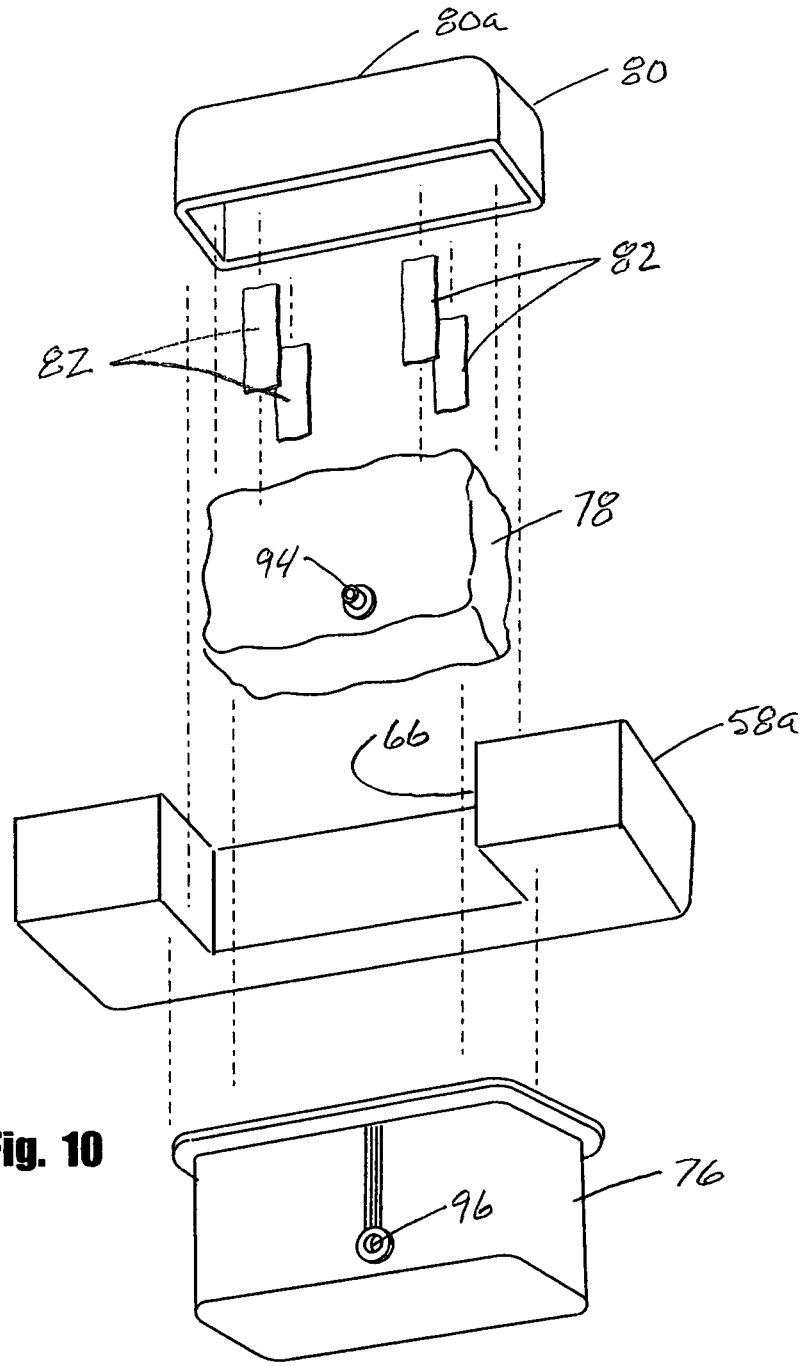
FIG. 10 is a generally perspective, exploded view of the supporting cushion assembly of the invention.

Connected to the forward portion 58*a* of first section 58 of the resilient body pad is the important patient support cushion assembly that is generally designated in FIGS. 9, 9A and 9B by the numeral 74. Patient support cushion assembly 74 here comprises an airbag housing 76 having an internal chamber 76*a* that is in communication with the guide passageway 66 that is formed in the forward portion of the first section 58*a* of the resilient body pad 56. Also forming a part of the important patient support cushion assembly 74 is an inflatable, deflatable airbag 78 that is disposed within the internal chamber of the airbag housing 76. Air bag 78 is movable relative to housing 76 between the first partially collapsed configuration shown in FIG. 9A, to the second fully expanded configuration shown in FIG. 9B. When the airbag 78 is in its normal at-rest configuration, it is in the position shown in FIGS. 5 and 9 of the drawings.

Forming another important aspect of the patient support cushion assembly 74 is a resiliently deformable patient support cushion 80 that is generally oval shaped in cross-section. Cushion 80, which includes yieldably deformable side and top walls 80*a* and 80*b* (FIG. 7), is operably associated with airbag 78 and is movable from a first lowered position shown in FIG. 9A wherein the cushion is disposed within the guide passageway 66 at a location below the upper surface 58*a* of the first section 58, to a second upraised position shown in FIG. 9, and to a third position shown in FIG. 9B, wherein the cushion is positioned a substantial distance above the upper surface 58*a* of the first section 58. More particularly, cushion 80 is coupled with the airbag by means of the plurality of generally "S" shaped coupling members 82 that are of the configuration shown in FIGS. 9 and 10 of the drawings.

Figure 8:
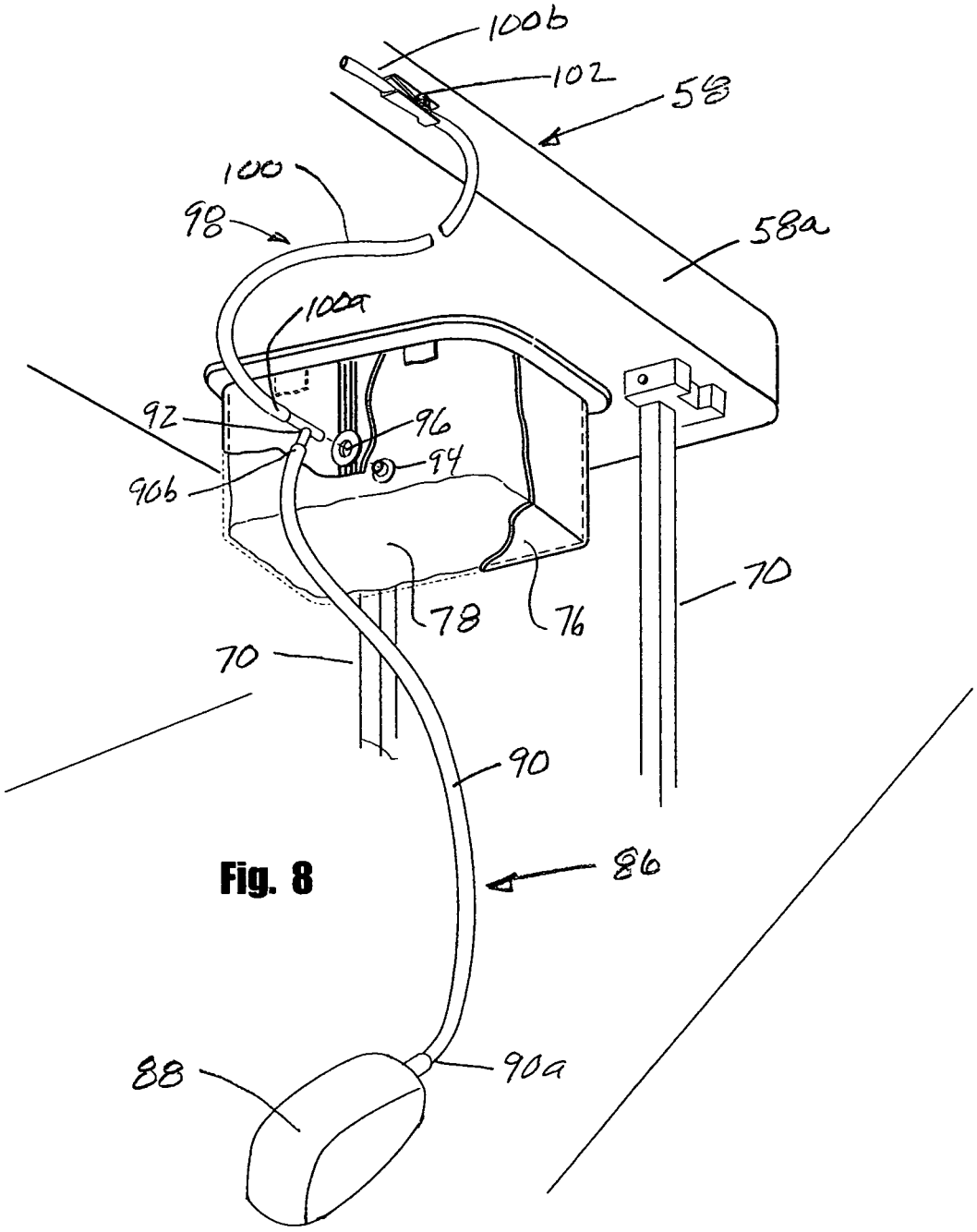
FIG. 8 is a generally perspective fragmentary bottom view of the alternate form of treatment platform illustrated in FIG. 5.

Connected to airbag 78 for moving the airbag between the first partially collapsed configuration shown in FIG. 9A and the expanded configurations shown in FIGS. 9 and 9B is a pump assembly 86 that here comprises a foot operated bellows 88 and an airline 90 that interconnects the foot operated bellows with the inflatable, deflatable airbag 78. Airline 90 has a first end 90*a* that is connected to the foot operated bellows 88 and a second end that is connected to one leg of a "T" connector 92 (FIG. 8). Another leg of the "T" connector is connected to the inlet 94*a* of an airbag connector 94 that is disposed within an opening 96 formed in the side wall of airbag housing 76. Airbag connector 94 has an outlet 94*b* that is in communication with the interior of the airbag 78 so that air under pressure generated by the foot pump will travel through the airline 90, through the airbag connector and into the interior of the airbag in a manner to controllably inflate the airbag.

Also forming a part of the pump assembly 86 is a vent line assembly 98 that is connected to airline 90 for controllably deflating the airbag. In the present form of the invention, the vent line assembly comprises a vent line 100 having a first end portion 100*a* that is connected to one leg of the "T" connector 92 and a second end portion 100*b* that is affixed to the side of the resilient body pad 56 by means of a conventional line clamp 102 which can be used to control the flow of air through vent line 100 (FIG. 8).

In the present form of the invention, platform 52 further includes a head support assembly 104 that is connected to the forward portion of the first section 58*a* of the resilient body pad 56 (FIG. 5). When the patient is in a prone position on the resilient body pad, the head support assembly 104 functions to support the face of the patient when the patient is lying face down, or the head of the patient when the patient is lying on his or her back.

In using the apparatus of the invention, the apparatus is first erected from the collapsed, folded configuration (not shown) into the operable configuration illustrated in FIG. 5 of the drawings. Hand straps 106 are provided on one side of the pad 56 to assist in transporting the apparatus.

The height of the platform can be adjusted by appropriately manipulating the downwardly extending adjustable front leg assemblies 70 and the downwardly extending adjustable rear leg assemblies 72. This is accomplished by moving the second portions 70*b* and 72*b* of the front and rear leg assemblies upwardly or downwardly, relative to the first portions 70*a* and 72 of the leg assemblies (FIG. 5).

As indicated in FIG. 5 of the drawings, the first and second portions of the front and rear leg assemblies are provided with vertically spaced apart pad receiving apertures 73 that are adapted to receive locking pins 75. Upon the sequential removal of the locking pins 75, the second portions of the leg assemblies can be moved from a first position to a second position, to controllably adjust the overall length of each of the leg assemblies and thereby adjust the height of the support platform. When the desired length of the leg assemblies is achieved, the locking pins 75 can be reinserted into the apertures 73 to hold the first and second leg portions securely in position.

With the apparatus is in the starting configuration shown in FIG. 5, the upper surface 80*a* of the resiliently deformable patient support cushion 80 is typically flush with the upper surface of the resilient body pad 56. Due to the resilient nature of the airbag 78 that supports the patient support cushion 80, while lying prone, any portion of the patient's body that protrudes outwardly, as for example the breasts of the patient, that is positioned within the guide passageway 66 will, upon operation of the line clamp 102, uniquely cause the support cushion 80 move telescopically downwardly within the passageway 66 to a lowered position, such as the position shown in FIG. 6 of the drawings, so as to avoid any discomfort to the patient.

Figure 7:
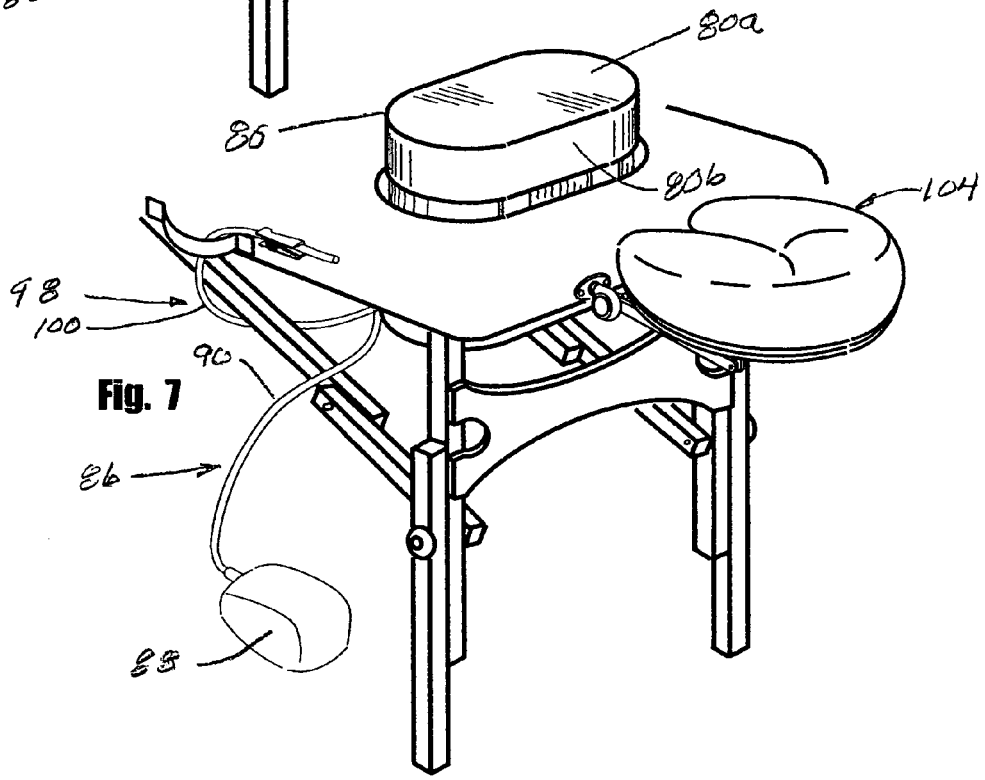
FIG. 7 is a generally perspective fragmentary view similar to FIG. 6, but showing the support cushion of the platform in an elevated position.

Similarly, when the patient is in a supine position and with line clamp 102 closed, operation of the foot pump 88 by the foot of the caregiver will cause the support cushion 80 to move upwardly relative to the surface of the body support pad 56 in the manner illustrated in FIG. 7 of the drawings. By way of example, when the patient's upper back is positioned over the pad, this controlled upward movement of the resiliently deformable support cushion raises the patient's chest and enables the accomplishment of a more effective and highly satisfying massage. Because of the unique positioning of the airbag within the guide passageway 66 and the ability to controllably inflate the airbag, the support cushion 80 can be raised to any degree desired by the caregiver, including into the position shown in FIG. 7 wherein the upper surface 80*a* of the support cushion resides above the surface of the body support pad by distance approximately one half the thickness "T" of the body support pad 56 (see FIG. 9B).

When the massage is complete, the forward and rearward legs can be pivoted in a direction toward the lower surface of the body support pad and the body support pad can then be folded to form a compact unit that can be easily transported and stored.

The invention claimed is:

1. A platform comprising:

a supporting frame having an upper frame and a pair support legs connected and extending downward from the upper frame;

a resilient pad having an upper surface and a lower surface opposite the upper surface;

a receiving chamber extending from the upper surface and extending through the resilient pad; and a resilient cushion disposed on an inflatable airbag and positioned within the receiving chamber and having a top wall extending through the receiving chamber and advanceable above and below the upper surface and a plurality of sidewalls corresponding to sidewalls of the receiving chamber.

2. The platform according to claim 1, further comprising an airbag housing having an internal chamber in communication with a guide passageway and having the inflatable airbag disposed within the internal chamber of the airbag housing and movable relative to the airbag housing.

3. The platform according to claim 2, wherein the plurality of sidewalls extend around the inflatable airbag.

4. The platform according to claim 3, further comprising a pump assembly connected to the inflatable airbag.

5. The platform according to claim 4, wherein the pump assembly includes a foot operated bellows and an airline interconnecting the foot operated bellows with the inflatable airbag.

6. The platform according to claim 5, further comprising an airbag connector connecting the airline and the inflatable airbag and includes a "T" shaped connector also connected to a vent line assembly.

7. The platform according to claim 6, wherein the vent line assembly includes a vent line having a first end portion connected to the airbag connector and a second end portion connected to a line clamp.

8. The platform according to claim 3, wherein the resilient cushion is coupled with the inflatable airbag using a coupling member.

9. The platform according to claim 1, further comprising a moveable support plate positioned below and supporting the resilient cushion.

10. A platform comprising:

a supporting frame having an upper frame and a pair support legs connected and extending downward from the upper frame;

a resilient pad having an upper surface and a lower surface opposite the upper surface;

a receiving chamber extending from the upper surface and extending through the resilient pad;

a resilient cushion disposed within the receiving chamber and having a top wall extending through the receiving chamber and advanceable above and below the upper surface and a plurality of sidewalls corresponding to sidewalls of the receiving chamber; and an airbag housing having an internal chamber in communication with a guide passageway and having an inflatable airbag disposed within the internal chamber of the airbag housing and movable relative to the airbag housing.

11. The platform according to claim 10, wherein the plurality of sidewalls extend around the inflatable airbag.

12. The platform according to claim 11, further comprising a pump assembly connected to the inflatable airbag.

13. The platform according to claim 12, wherein the pump assembly includes a foot operated bellows and an airline interconnecting the foot operated bellows with the inflatable airbag.

14. The platform according to claim 13, further comprising an airbag connector connecting the airline and the inflatable airbag and includes a "T" shaped connector also connected to a vent line assembly.

15. The platform according to claim 14, wherein the vent line assembly includes a vent line having a first end portion connected to the airbag connector and a second end portion connected to a line clamp.

16. The platform according to claim 11, wherein the resilient cushion is coupled with the inflatable airbag using a coupling member.

17. A platform for supporting an individual in a prone position comprising:

(a) a support frame including a forward portion having downwardly extending front legs and a rearward portion connected to said forward portion and having downwardly extending rear legs;

(b) a resilient body pad supported by said support frame and having (1) an upper surface (2) a lower surface, and (3) a guide passageway (i) positioned with the forward portion of said support frame and (ii) extending through said upper surface;

(c) a patient support cushion assembly disposed in said guide passageway and comprising:

(i) an airbag housing having an internal chamber engaging a side of said guide passageway of said resilient body pad;

(ii) an inflatable, deflatable airbag disposed within said internal chamber of said airbag housing and being movable between a partially collapsed configuration and a expanded configuration; and (iii) a resilient patient support cushion advanced by said airbag and movable within said guide passageway of said resilient body pad from a lowered position at which said support cushion is disposed within said guide passageway and at a location below said upper surface of a first section to an upraised position and to an extended position at which said support cushion is positioned above said upper surface of said first section; and (d) a pump assembly connected to said airbag for moving said airbag between said partially collapsed configuration and said expanded configuration.

18. The platform as defined in claim 17 in which each of said downwardly extending front legs includes a first portion and a second portion connected to said first portion and movable relative thereto from a first position to a second position and in which each of said downwardly extending rear legs includes a first portion and a second portion connected to said first portion and movable relative thereto from a first position to a second position.

19. A platform for supporting an individual in a prone position comprising:

(a) a support frame including a forward portion having downwardly extending front legs and a rearward portion connected to said forward portion and having downwardly extending rear legs each of said downwardly extending front legs of said support frame including a first portion and a second portion connected to said first portion and movable relative thereto from a first position to a second position and each of said downwardly extending rear legs of said support frame including a first portion and a second portion connected to said first portion and movable relative thereto from a first position to a second position;

(b) a resilient body pad supported by said support frame, said resilient body pad comprising first and second sections, said first section having an upper surface and a lower surface and including a forward portion provided with a guide passageway said guide passageway being generally oval shaped in cross-section;

(c) a patient support cushion assembly connected to said forward portion of said first section of said resilient body pad, said patient support cushion assembly comprising:

(i) an airbag housing having an internal chamber in communication with said guide passageway formed in said forward portion of said first section, said airbag housing being generally oval shaped in cross-section;

(ii) an inflatable, deflatable airbag disposed within said internal chamber of said airbag housing, said airbag being movable between a partially collapsed configuration and a expanded configuration; and (iii) a resiliently deformable patient support cushion operably associated with said airbag and being movable from a lowered position wherein said cushion is disposed within said guide passageway and at a location below said upper surface of said first section to an upraised position and to an extended position wherein said cushion is positioned above said upper surface of said first section, the resiliently deformable patient support cushion independent moveable with respect to the resilient body pad; and (d) a pump assembly connected to said airbag for moving said airbag between said partially collapsed configuration and said expanded configuration, said pump assembly comprising a foot operated bellows and an airline interconnecting said foot operated bellows with said inflatable, deflatable airbag.

20. The platform as defined in claim 19 in which each of said downwardly extending front legs of said support frame includes a locking pin for locking said second portion thereof in said first position and in which each of said downwardly extending rear legs of said support frame includes a locking pin for locking said second portion thereof in said first position.

21. A platform comprising:

a supporting frame having an upper frame and a pair support legs connected and extending downward from the upper frame;

a resilient pad having an upper surface and a lower surface opposite the upper surface;

a receiving chamber extending from the upper surface and extending through the resilient pad; and a resilient cushion having a top wall extending through the receiving chamber and advanceable above and below the upper surface;

a cushion support plate positioned on a bottom of the resilient cushion; and a positioning mechanism connected to the cushion support plate and having a motor assembly to advance the resilient cushion above and below the upper surface.

22. A platform comprising:

a supporting frame having an upper frame and a pair support legs connected and extending downward from the upper frame;

a resilient pad having an upper surface and a lower surface opposite the upper surface;

a receiving chamber extending from the upper surface and extending through the resilient pad;

a resilient cushion disposed within the receiving chamber and having a top wall extending through the receiving chamber and advanceable above and below the upper surface and a plurality of sidewalls corresponding to sidewalls of the receiving chamber; and a moveable support plate positioned below and supporting the resilient cushion.

* * * * *